US007784589B2

(12) United States Patent
Fischer

(10) Patent No.: US 7,784,589 B2
(45) Date of Patent: Aug. 31, 2010

(54) ELEVATOR LIFT CAGE LOAD MEASURING ASSEMBLY

(75) Inventor: Daniel Fischer, Villarsel-Sur-Marly (CH)

(73) Assignee: Inventio AG, Hergiswil (CH)

( * ) Notice: Subject to any disclaimer, the term of this patent is extended or adjusted under 35 U.S.C. 154(b) by 567 days.

(21) Appl. No.: 11/771,242

(22) Filed: Jun. 29, 2007

(65) Prior Publication Data

US 2008/0006486 A1 Jan. 10, 2008

(30) Foreign Application Priority Data

Jul. 10, 2006 (EP) ..... 06116902

(51) Int. Cl.
*B66B 1/34* (2006.01)

(52) U.S. Cl. ..... 187/393; 187/401; 177/147

(58) Field of Classification Search ..... 187/292, 187/391–393, 401, 281; 177/47, 136, 147, 177/184–189
See application file for complete search history.

(56) References Cited

U.S. PATENT DOCUMENTS

| | | | | |
|---|---|---|---|---|
| 3,323,606 | A * | 6/1967 | Bruns et al. | 177/147 |
| 4,479,560 | A | 10/1984 | Day | |
| 5,025,896 | A * | 6/1991 | Arabori et al. | 187/292 |
| 5,046,584 | A | 9/1991 | Yoo et al. | |
| 5,086,882 | A * | 2/1992 | Sugahara et al. | 187/410 |
| 6,305,503 | B1 | 10/2001 | Suzuki et al. | |
| 6,357,554 | B1 | 3/2002 | Valk | |
| 6,450,299 | B1 * | 9/2002 | Lysaght | 187/393 |
| 6,715,587 | B2 * | 4/2004 | Sittler et al. | 187/401 |
| 2009/0120728 | A1 * | 5/2009 | Traktovenko et al. | 187/391 |
| 2009/0236184 | A1 * | 9/2009 | Ueda et al. | 187/247 |

FOREIGN PATENT DOCUMENTS

| | | | |
|---|---|---|---|
| EP | 0 151 949 | A2 | 8/1985 |
| EP | 0 545 572 | A2 | 6/1993 |
| EP | 0 810 426 | A1 | 12/1997 |
| GB | 2 267 078 | A | 11/1993 |
| WO | WO 01/09575 | A | 2/2001 |
| WO | WO 2004/089802 | A | 10/2004 |

* cited by examiner

*Primary Examiner*—Jonathan Salata
(74) *Attorney, Agent, or Firm*—Ladas & Parry LLP

(57) ABSTRACT

Load measuring equipment has a small-area load sensor arranged between a support and a first damping body for vibration damping of parts relative to the support. The support may be a bracket and the parts may be a lift drive engine. The force on the sensor, which may be the force emanating from an engine foot of the drive engine made up of cage weight, cage load, weight of the counterweight, weight of the support cables and weight of the drive unit, is a small portion of the force on the support, such as the bracket. The ratio of the area of the first damping body to the load sensor determines the ratio of the force acting on the damping body to the force acting on L, and sensed by Z the load sensor.

7 Claims, 3 Drawing Sheets

ELEVATOR LIFT CAGE LOAD MEASURING ASSEMBLY

The present invention relates to equipment for determining the load in a lift cage of a lift, wherein at least one load sensor is provided in at least one support of parts that are acted on by vibration and that are supported on at least one damping body, which is carried by a bearer for vibration damping of the parts, acted upon by vibration relative to the bearer.

BACKGROUND OF THE INVENTION

Equipment for measuring the load in a lift cage of a lift has become known from U.S. Pat. No. 6,305,503 B1, which depicts a variety of measurement methods. A drive unit driving the lift cage is supported on resilient bearings. In an illustrative embodiment, a potentiometer producing a measurable voltage in dependence on the deformation of the bearing is arranged at one of the bearings. The force acting on the bearings is made up of the cage weight, the cage load, the weight of the counterweight, the weight of the support means and the weight of the drive unit. A load change is measurable at the resilient bearings as a change in voltage.

BRIEF DESCRIPTION OF THE INVENTION

An object of the present invention is to provide an efficient system for determination of the load in a lift cage of a lift, which can be retrofit into existing lift equipment.

An advantage achieved by the invention is that, in comparison with conventional load measuring equipment, an economic solution for determination of the load in a lift cage can be realized. Moreover, by use of a small-area load sensor as employed, the sensor can be placed in a simple manner in the support for parts that are acted on by vibration, for example, between a support bracket and insulating bodies for vibration damping of a drive engine, a lift cage, a support means fixing point or deflecting rollers. It is additionally advantageous that, in the case of a subsequent installation of the load measuring equipment according to the invention, neither changes or reconstruction of the damping devices are needed, nor are their damping characteristics changed. In the case of retrofitting the damping device only has to be raised slightly from a support bracket and the load sensor, placed in the gap which forms.

In accordance with the foregoing, at least one load sensor is provided in at least one support for parts that are acted on by vibration and which are supported by at least one damping body—which is carried by a bearer—for vibration damping of the parts which are acted on by vibration relative to a bearer, wherein the load sensor can be mounted between the bearer and the damping body without constructional changes to the bearer or of the damping body.

BRIEF DESCRIPTION OF THE DRAWINGS

The invention is explained in more detail in the following detailed disclosure of a preferred but nonetheless illustrative embodiment of the invention, taken in association with the accompanying figures, in which.

DETAILED DESCRIPTION OF THE INVENTION

Figure 1:
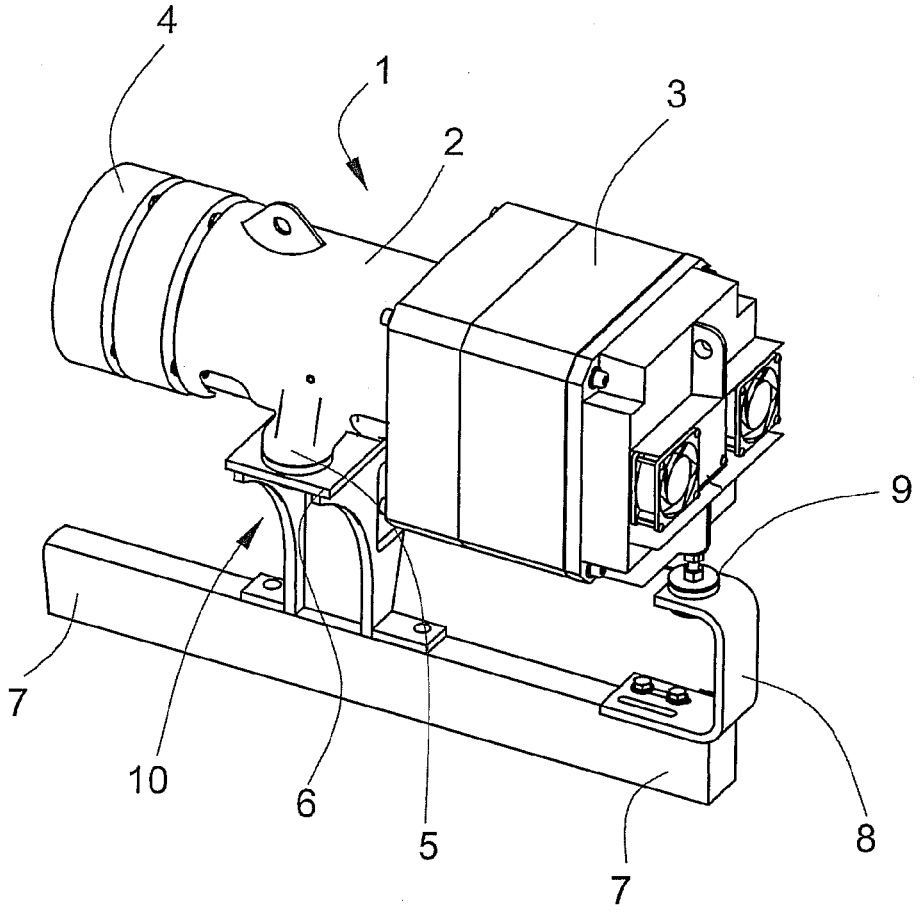
FIG. 1 shows a drive engine with load measuring equipment according to the invention.

FIG. 1 shows a gearless drive engine 1 comprising an enclosed drive pulley 2, at which a motor 3 is arranged at one end and a brake 4 at the other end. The drive pulley 2 is supported by means of two engine feet 5 (the front machine foot 5 is visible) on a bracket 6 of a support frame 7. A support 8 carrying an auxiliary bearing 9 of the motor 3 is also arranged at the support frame.

Figure 2:
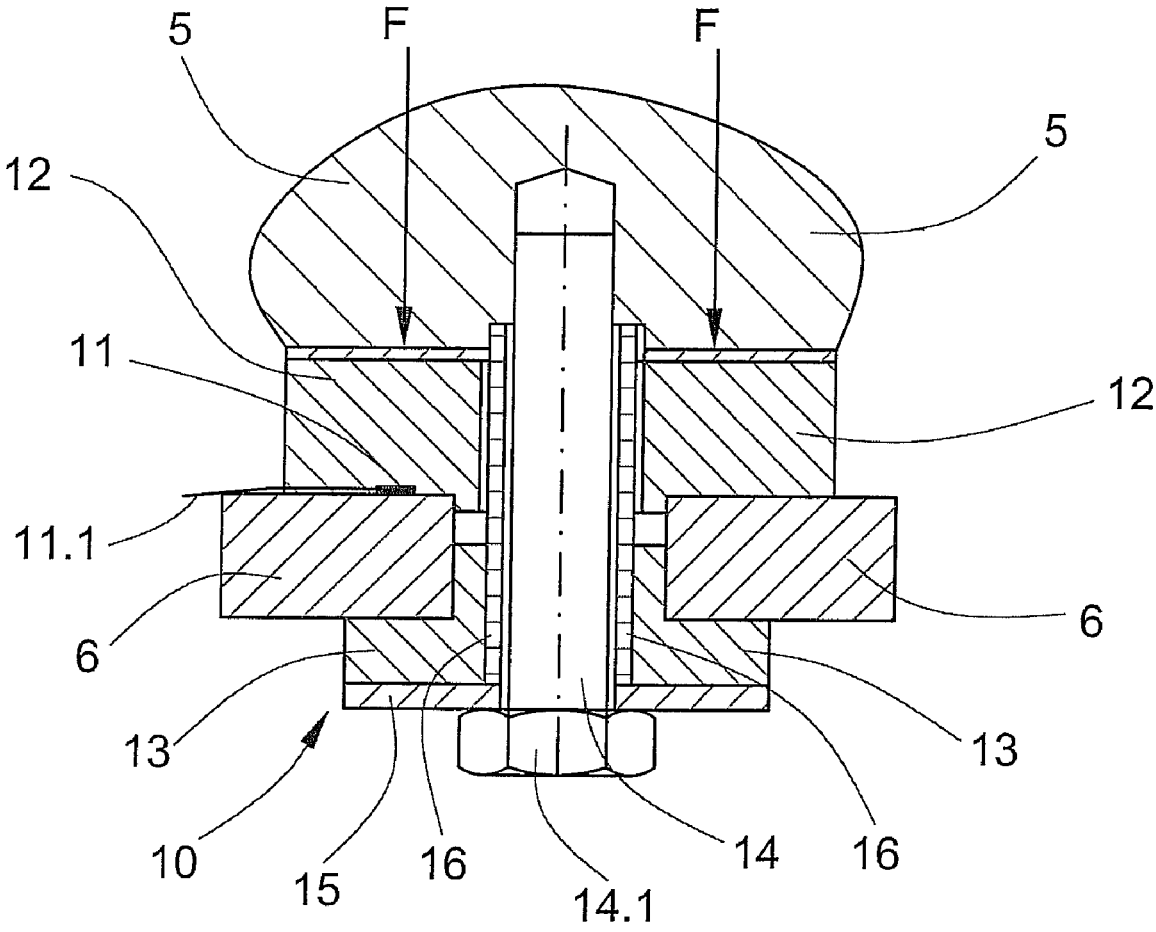
FIG. 2 shows a typical section through a support with the load measuring equipment.

FIG. 2 shows a section through a support 10 on which the machine foot is supported. A small-area load sensor 11, as known in the art, is arranged between the bracket 6 and a first damping body 12. The damping body 12, also called insulating body 12, serves for vibration damping of the drive engine 1 relative to the bracket 6. The output signal of the load sensor 11 is measurable at electrical conductors 11.1. The force F acting on the support 10 is composed of the lift cage weight, the cage load, the weight of the lift counterweight, the weight of the support means and the weight of the drive unit, wherein the total force acts half as force F on the front support 10 and half on the rear support. The front support 10 and rear support are of identical construction.

A second damping body 13 is provided below the bracket 6 and together with the first damping body 12 is pressed against the bracket 6 by means of a screw 14 with a hexagonal head 14.1 and a washer 15, which is threaded into the engine foot 5. A spacer sleeve 16 bearing against the engine foot 5 limits the pressing of the first damping body 12 and the second damping body 13. The drive engine 1 is fixed on the bracket 6 by the pressing of the damping bodies 12, 13, but the drive engine 1 remains insulated in terms of vibration relative to the bracket 6. The first damping body 12 can alternatively also consist of several parts.

Figure 3:
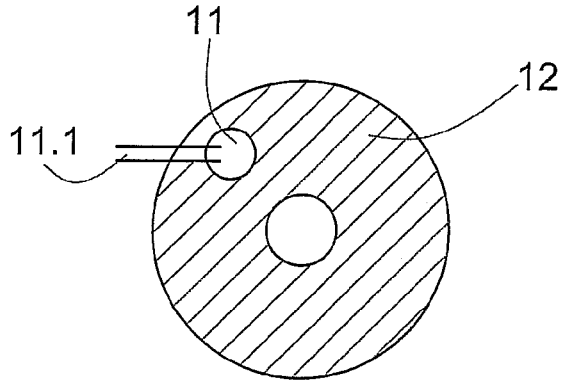
FIG. 3 shows an area comparison between a damping body and the small-area load sensor of the invention.

FIG. 3 shows an area comparison between the first damping body 12 and the small-area load sensor 11. In the illustrated example the effective area of the damping body 12 is 21.1 $cm^2$ and the contact area of the load sensor 11 against the damping body is 0.64 $cm^2$. A force ratio of 1:33 results from the area ratio. The force acting on the load sensor 11 is accordingly F/33. The load sensor 11 or its electronic evaluating system is calibrated to zero when the lift cage is empty and to a standardized output voltage, for example 10 volts, when there is maximum load in the lift cage.

The above calculation is based on a load sensor 11 with a diameter of 9.5 mm and a thickness of approximately 0.2 mm in the measuring region illustrated as a circle. With a thickness of merely 0.2 mm the load sensor 11 can be retrofitted in a simple manner in existing lift installations. For this purpose the screw 14 is loosened and the drive engine 1 slightly raised until a small gap forms between the bracket 6 and the first damping body 12. Thereafter the load sensor 11 can be pushed into the gap without constructional change of the bracket 6 or of the damping body 12, the drive engine 1 lowered and the screw 14 retightened.

Figure 4:
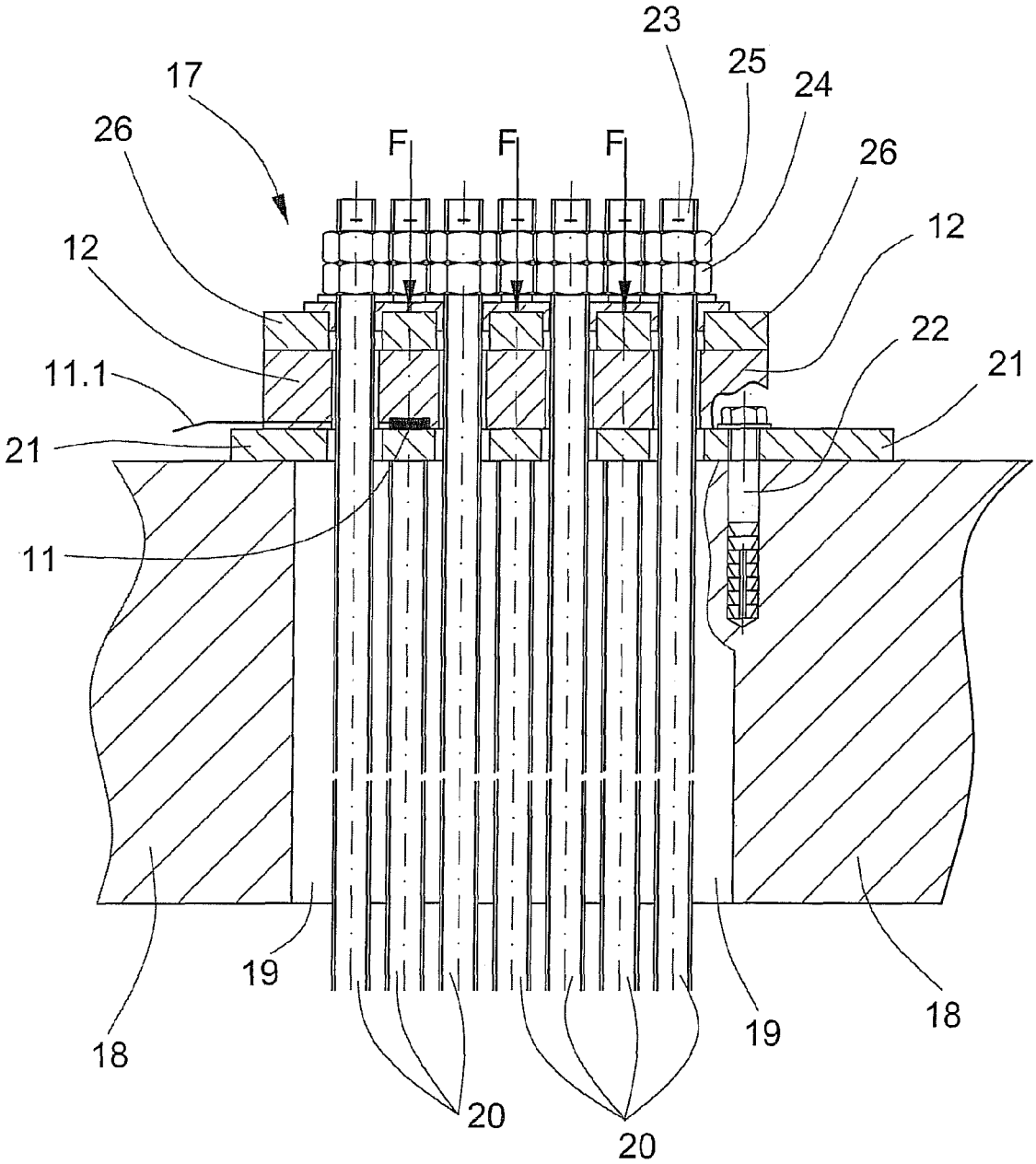
FIG. 4 shows a fixing point with load measuring equipment of the invention for support means in the form of cables or belts having the rods as end connections.

FIG. 4 shows a support means fixing point construction 17 with a load sensor 11 for measuring the load in a support means consisting of cables or belts. Serving as a bearer 18 is a concrete ceiling or a steel beam with a cut-out 19, through which tie rods 20 of end connections for the support means extend. A base plate 21 covers the cut-out 19 at the upper side of the bearer 18, wherein the tie rods 20 penetrate the base plate 21. The first damping body 12 is carried by the base plate 21, which is secured by means of fixing screws 22 to the bearer 18, wherein the load sensor 11 is arranged between the base plate 21 and the first damping body 12. The force F acting on the cover plate 26 is transmitted to the first damping body 12 and by this to the base plate 21, wherein, as explained above, a portion of the force F also acts on the load sensor 11.

Provided at the upper end of each tie rod 20 is a threaded portion 23 by means of which, together with an installed nut 24, the exact position of the respective support means is settable. The nut is secured by means of a locknut 25. Each nut 24 is carried by the cover plate 26, which in turn rests on the first damping body 12. The tie rods 20 penetrate the first damping body 12 and the cover plate 26.

The small-area load sensor 11 can also be placed in the region of other parts that are acted on by vibration of the lift equipment, for example, between a support bracket and insulating bodies for vibration damping of the lift cage or deflecting roller. Alternatively, more than one load sensor 11 can also be used in a support 10 or at least one load sensor 11 can be provided in more than one support 10.

Damping bodies 12 of greater resistance are usually used for supports 10 of the lift cage than for supports 10 of the drive engine 1. In that case the load sensor 11 can also have a thickness of approximately 1 mm or less. The area ratio of the area of the load sensor 11 in the measuring region to the effective area of the damping body 12 can also be approximately 1:10, or less.

I claim:

1. An assembly for determining a load in a lift cage of a lift, comprising a damping body bearer located on a first part acted on by vibration, a vibration damping body located on a second part acted on by vibration and to be vibration damped with respect to the first part, the bearer and damping body having a construction wherein each has an adjacent surface with a corresponding effective area intended to be in contact with the other while under the load, and a load sensor positioned between the adjacent surfaces and in the effective area of the damping body and having a thickness such that it may be inserted between the adjacent surfaces without substantial change of the construction from a configuration in which the load sensor is not present.

2. The assembly according to claim 1, wherein the load sensor has a small measurement region area in comparison with the effective area of the damping body and is thereby exposed to only a fraction of a force exerted on the damping body by the parts acted on by vibration.

3. The assembly according to claim 2, wherein the sensor's thickness is no greater than approximately 1 mm.

4. The assembly according to claim 2 or 3, wherein an area ratio of the load sensor measurement region to the effective area of the damping body is no greater than approximately 1:10.

5. A lift with a lift cage comprising the assembly of claim 1 or 2.

6. A method for installation of a load sensor of a size and construction such that it may be mounted in contact between a bearer and a damping body without substantial constructional change of the bearer or the damping body in a support for parts that are acted on by vibration and that are supported upon the damping body carried by the bearer for vibration damping of the parts relative to the bearer, comprising the steps of:

raising the parts from the bearer until a small gap can be established between the bearer and the damping body;

inserting the load sensor into the gap without a constructional change to the bearer or the damping body; and lowering the parts onto the bearer.

7. The method according to claim 6, wherein the part and bearer comprise portions of a lift cage of a lift retrofitted with the load sensor.

* * * * *